US005547385A

United States Patent [19]

Spangler

[11] Patent Number: 5,547,385

[45] Date of Patent: Aug. 20, 1996

[54] BLIND MATING GUIDES ON BACKWARDS COMPATIBLE CONNECTOR

[75] Inventor: Todd M. Spangler, Charlotte, N.C.

[73] Assignee: The Whitaker Corporation, Wilmington, Del.

[21] Appl. No.: 250,204

[22] Filed: May 27, 1994

[51] Int. Cl.[6] ..... H01R 4/66

[52] U.S. Cl. ..... 439/101; 439/108

[58] Field of Search ..... 439/101, 108, 439/567, 378

[56] References Cited

U.S. PATENT DOCUMENTS

| | | | |
|---|---|---|---|
| 3,178,670 | 4/1965 | Daniel et al. . | |
| 3,530,427 | 9/1970 | Stauder et al. . | |
| 3,636,503 | 1/1972 | Bernutz et al. . | |
| 3,731,259 | 5/1973 | Occhipinti . | |
| 3,987,344 | 10/1976 | Ambruoso, Sr. et al. | 317/100 |
| 4,179,178 | 12/1979 | Bachman et al. . | |
| 4,568,134 | 2/1986 | DiMondi . | |
| 4,616,893 | 10/1986 | Feldman | 439/108 OR |
| 4,664,456 | 5/1987 | Blair et al. . | |
| 4,776,811 | 10/1988 | Humphrey | 439/378 |
| 4,790,763 | 12/1988 | Weber et al. | 439/681 |
| 4,818,237 | 4/1989 | Weber | 439/693 |
| 4,842,543 | 6/1989 | Davis | 439/378 |
| 4,904,194 | 2/1990 | Kilsdonk et al. | 439/101 |
| 4,925,400 | 5/1990 | Blair et al. | 439/374 |
| 4,968,261 | 11/1990 | Mizunuma | 439/108 |
| 4,998,892 | 3/1991 | Shiley | 439/381 |
| 5,080,604 | 1/1992 | Rider et al. | 439/357 |
| 5,102,353 | 4/1992 | Brunker et al. | 439/608 |
| 5,178,561 | 1/1993 | Lindeberg et al. | 439/571 |
| 5,183,405 | 2/1993 | Elicker et al. | 439/108 |
| 5,195,899 | 3/1993 | Yatsu et al. | 439/101 |
| 5,199,880 | 4/1993 | Arai | 439/65 |
| 5,211,585 | 5/1993 | Douty et al. | 439/680 |
| 5,234,353 | 8/1993 | Scholz et al. | 439/289 OR |
| 5,248,458 | 9/1993 | Daly | 264/40.1 |
| 5,281,165 | 1/1994 | McCleerey et al. | 439/510 |
| 5,356,300 | 10/1994 | Costello | 439/101 OR |

OTHER PUBLICATIONS

"Blind Mating Guides With Ground Contacts" Patent Application; Ser. No. 08/122,741; Filed Sep. 16, 1993.

*Primary Examiner*—P. Austin Bradley
*Assistant Examiner*—Daniel Wittels
*Attorney, Agent, or Firm*—Anton P. Ness

[57] ABSTRACT

An electrical connector assembly (1) comprises, a first electrical connector (2), electrical contacts (7) in the first electrical connector extending to a mating face (6) of the connector (2), alignment posts (12) and first ground contacts (10) along the alignment posts (12), and a mating electrical connector (3) provided with post receiving cavities (11) with second ground contacts (10) in the cavities (11) engaging the first ground contacts (10) along the posts (12), and terminal portions (27) on the ground contacts (10) for backwards compatibility.

15 Claims, 7 Drawing Sheets

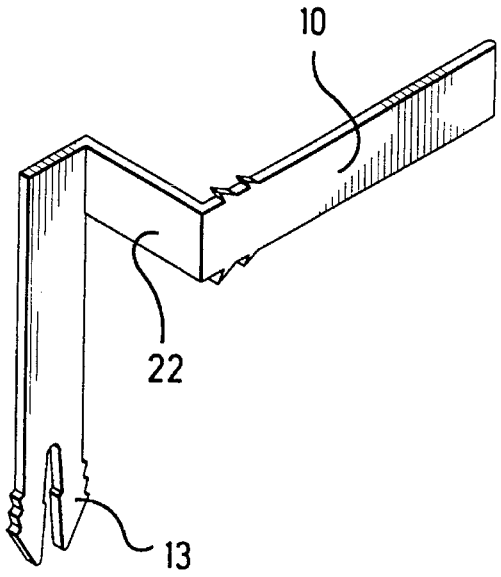
FIG. 9
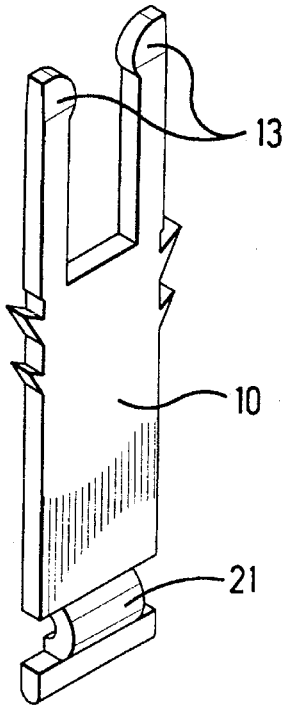
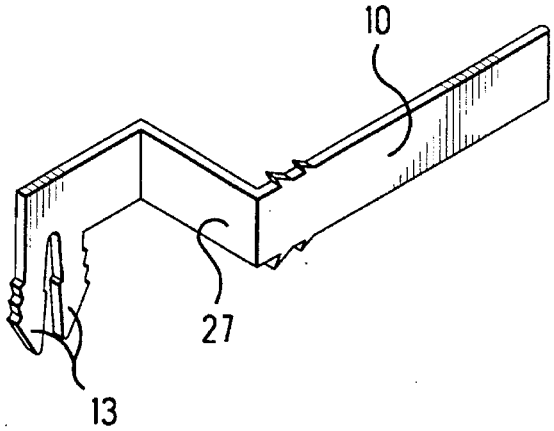
FIG. 12
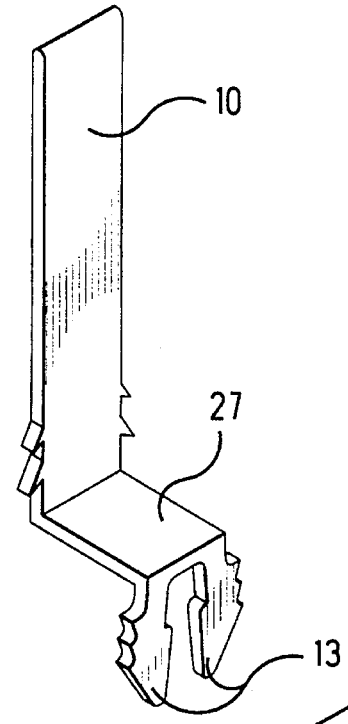
FIG. 5

BLIND MATING GUIDES ON BACKWARDS COMPATIBLE CONNECTOR

FIELD OF THE INVENTION

The invention to be described relates to an electrical connector with alignment posts to align the mating face with another, mating electrical connector.

BACKGROUND OF THE INVENTION

According to U.S. Pat. No. 4,842,543, a known electrical connector comprises, an insulating housing having a mating face for engaging another mating connector; electrical contacts in the housing extending toward the mating face; and posts projecting beyond the mating face. The posts serve as obstructions to protect the contacts from damage. The posts align the mating face with the mating electrical connector prior to connection of the mating face with the mating electrical connector, and do not provide a ground connection to an electrical terminal in the connector.

According to U.S. Pat. No. 4,904,194, grounding pins project from an electrical connector, and the pins incorporate springs that bias the grounding pins sideways against sides of sockets in a mating electrical connector. The pins establish a ground connection between the connector with the mating electrical connector without establishing a ground connection to an electrical terminal in the connector.

SUMMARY OF THE INVENTION

A connector according to the invention is suitable for connecting an apparatus, such as a disk drive of a computer to a docking work station. The entire disk drive is inserted into a docking opening in the work station, which requires the connector on the disk drive to align with a mating electrical connector in the docking opening. Alignment posts on the connector do not project beyond a mating face of the connector on the disk drive. The alignment posts align the mating face with the mating electrical connector prior to connection signal contacts along of the mating face with those of the mating electrical connector which also has posts protruding beyond the mating face.

Upon connection of a disk drive into a docking opening, the disk drive becomes connected to activated circuits in a docking work station. Arcing due to electrostatic discharge could result when a connector on the disk drive is connected to the activated circuits. According to a feature of the invention, electrical ground contacts on alignment posts of the connector will incur the arcing to protect the activated circuits from electrostatic discharge.

Ground contacts extend along insulating alignment posts. Prior to connecting the signal contacts along the mating face of the connector with those of a mating electrical connector on the docking work station, the ground contacts on the alignment posts engage corresponding ground contacts on the mating electrical connector. Thus, the ground contacts of both connectors become engaged electrical connector before the signal contacts become engaged. It can be said of the invention that the signal contacts, combined with the longer ground contacts, provide at least two levels of sequenced connections with the mating electrical connector. In other words, the ground contacts of the connectors first engage, and subsequently, the signal contacts become engage.

Thus, according to another feature of the invention, a connector includes signal contacts and ground contacts, with the ground contacts being longer than the signal contacts and extending beyond a mating face of the connector to establish a ground connection with a mating electrical connector, prior to connection of the signal contacts along the mating faces of the connectors.

According to yet another feature of the invention, an electrical connector with ground contacts along alignment posts is matable with a mating electrical connector having alignment channels receiving the alignment posts. Both of these connectors are backwards compatible, because they both mate with known, previously designed, connectors that are constructed, respectively, without alignment posts and alignment channels. Further to achieve backwards compatibility, the ground contacts of the backwards compatible connectors use the same footprint, i.e., the same connection to a circuit board as do the board locks on the known, previously designed, connectors.

An objective of the invention is to provide an electrical connector with ground contacts that will discharge an electrostatic charge to chassis ground potential prior in sequence to connection of other electrical contacts of the same connector with a mating electrical connector.

Another objective of the invention is to provide an electrical connector with post receiving cavities to receive alignment posts and ground contacts in the alignment posts, and which connector is backwards compatible.

Another objective of the invention is to provide an electrical connector assembly, wherein a first electrical connector is provided with alignment guide posts and ground contacts in the alignment posts, and a mating electrical connector is provided with post receiving cavities with ground contacts in the cavities engaging the ground contacts along the posts, both of which connectors are backwards compatible.

Another objective of the invention is to provide straddle mount, right angle, and low profile versions of the plug connectors along with a vertical R/A receptacle version.

Embodiments of the invention will now be described by way of example with reference to the accompanying drawings according to which:

DESCRIPTION OF THE DRAWINGS

FIG. 6 is a side view of the connector with guide posts as shown in FIG. 1, and a prior art mating electrical connector without ground contacts in channels, illustrating a backwards compatible feature;

FIG. 9 is an isometric view of a ground contact in the connector shown in FIG. 7;

FIG. 12 is a isometric view of a ground contact in the connector shown in FIG. 10.

DETAILED DESCRIPTION

Figure 1:
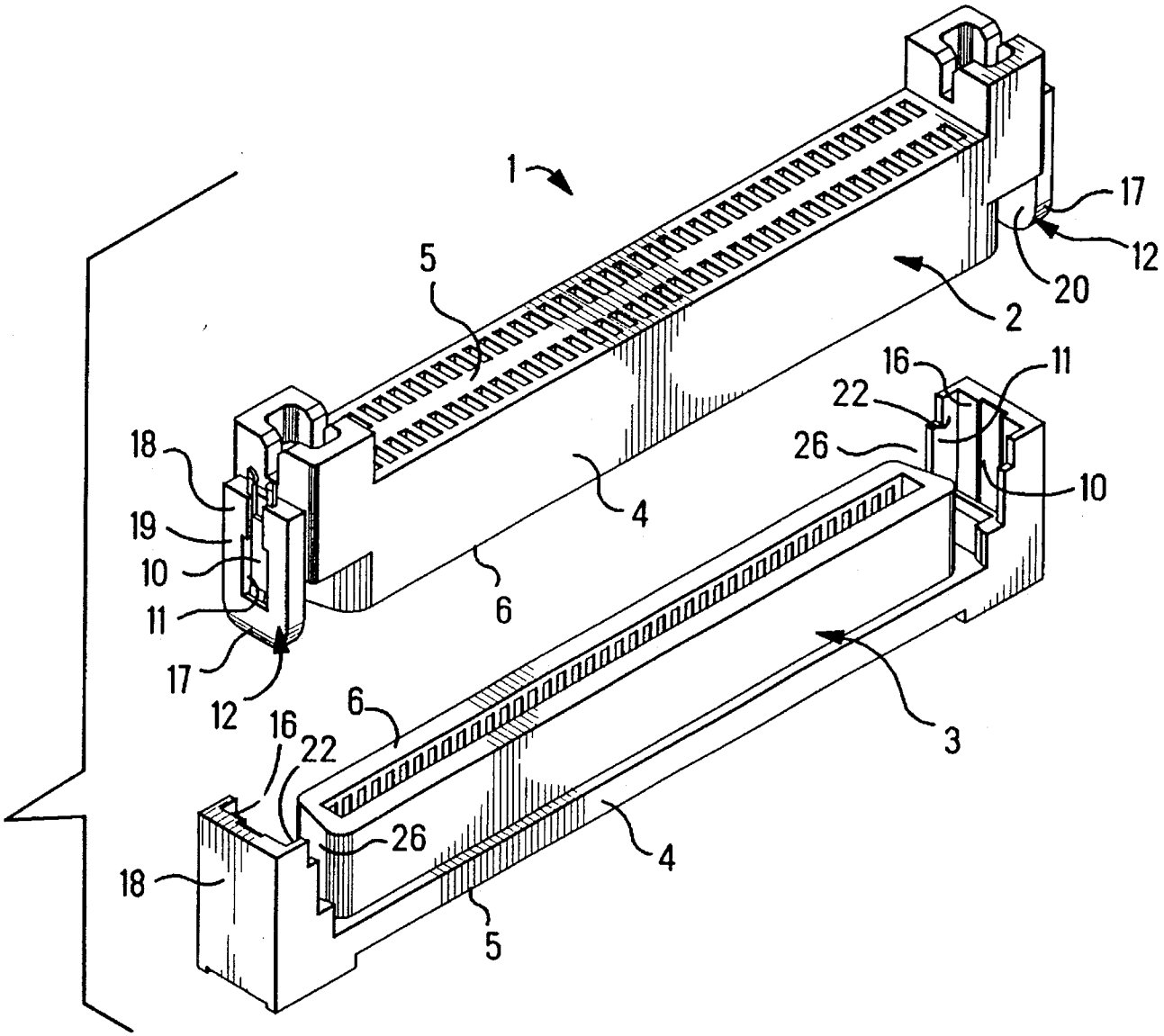
FIG. 1 is a isometric view of an electrical connector assembly comprising an electrical connector and a mating electrical connector, with ground contacts extending along guide posts of the first electrical connector, and with ground contacts along channels in the mating electrical connector.

With reference to FIGS. 1–4 and 10, an electrical connector assembly 1 comprises an electrical connector 2 and another, mating electrical connector 3; each of which connectors 2, 3 comprises an insulating housing 4 having a rear face 5 and a mating face 6; and electrical signal contacts 7, FIGS. 2, 6, 7 and 10, in and extending through contact receiving cavities through the housing 4 extend from the rear face 5 toward and to the mating face 6.

Each electrical connector 2, 3 further comprises electrical terminals 8 on rear ends of the electrical contacts 7 that project from the rear face 5 for connection to a circuit board, not shown. Each connector 2, 3 further comprises electrical ground contacts 10, FIGS. 1, 2, 3, 4, 6, 7 and 8, extending in and through ground contact receiving cavities 11 in end portions 18 of the housing 4.

Figure 5:
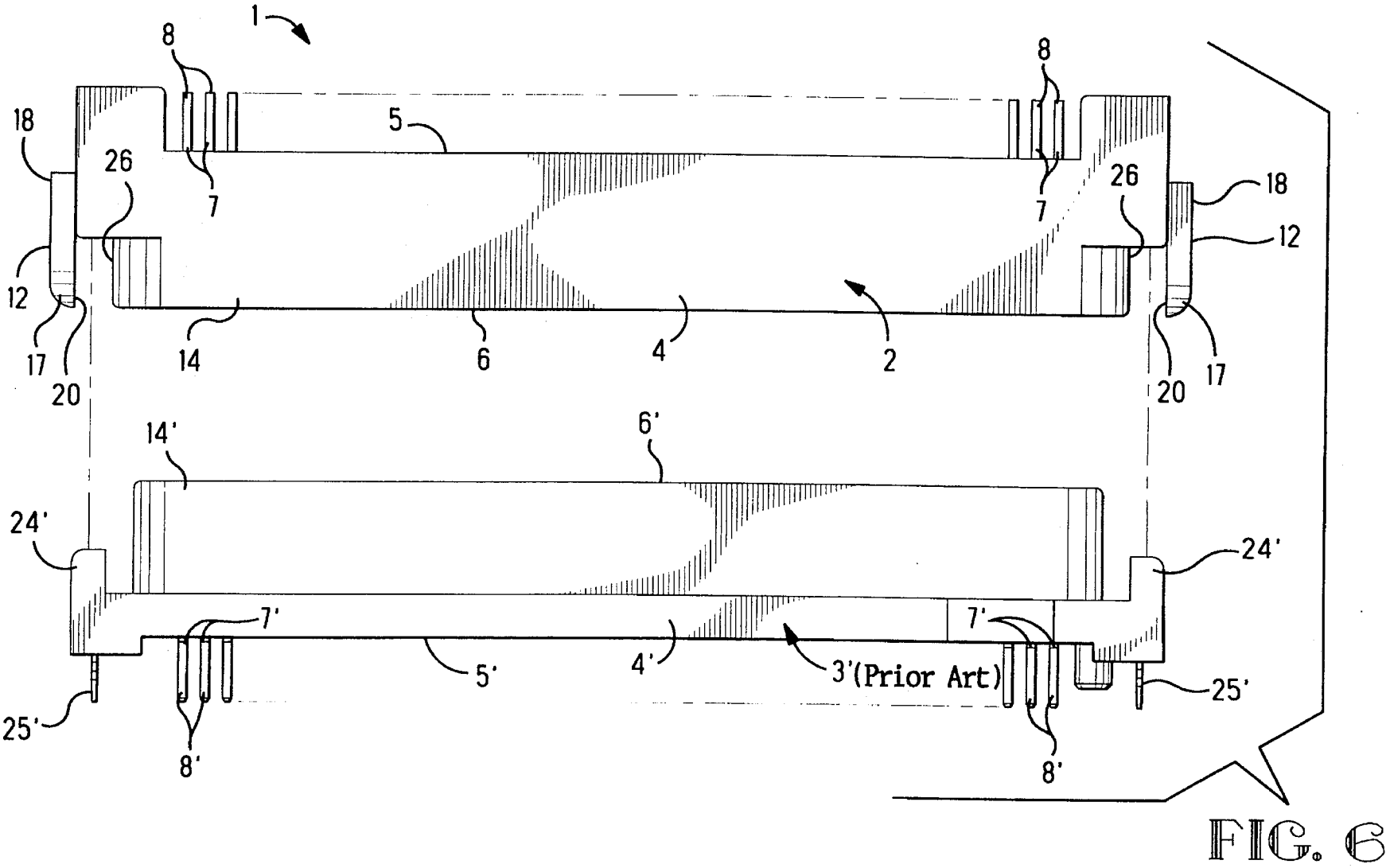
FIG. 5 is an isometric view of mating ground contacts in the connectors shown in FIG. 1.

Each electrical connector 2 further comprises insulative posts 12 and the conductive ground contacts 10 extending along the posts 12. The ground contacts 10, together with the electrical contacts 7, extend through the housing 4 and through the rear face 5. Electrical terminals 13 on the ground contacts 10 project from the rear face 5 of the housing 4 for connection to a circuit board, not shown. In FIG. 5, the terminal 13 is bifurcated to straddle opposite sides of a circuit board. The connector 2 in FIG. 1 that uses the bifurcated terminal 13 is a straddle mount version of the connector 2. The posts 12 and the ground contacts 10 project in the same direction as the mating face 6 to establish a ground connection of the ground contacts 10 when the connectors 2, 3 are mated. A shroud 14 on the housing 4 encircles the signal contacts 7 at the mating face 6. The ground contacts 10 engage the mating ground contacts 10 in the mating electrical connector 3 while the posts 12 engage the mating electrical connector 3. The shrouds 14 of the connectors overlap, with the shroud 14 on the connector 2 encircling the shroud 14 on the connector 3. For example, the connector 2 is a plug connector, and the connector 3 is a receptacle connector.

Figure 3:
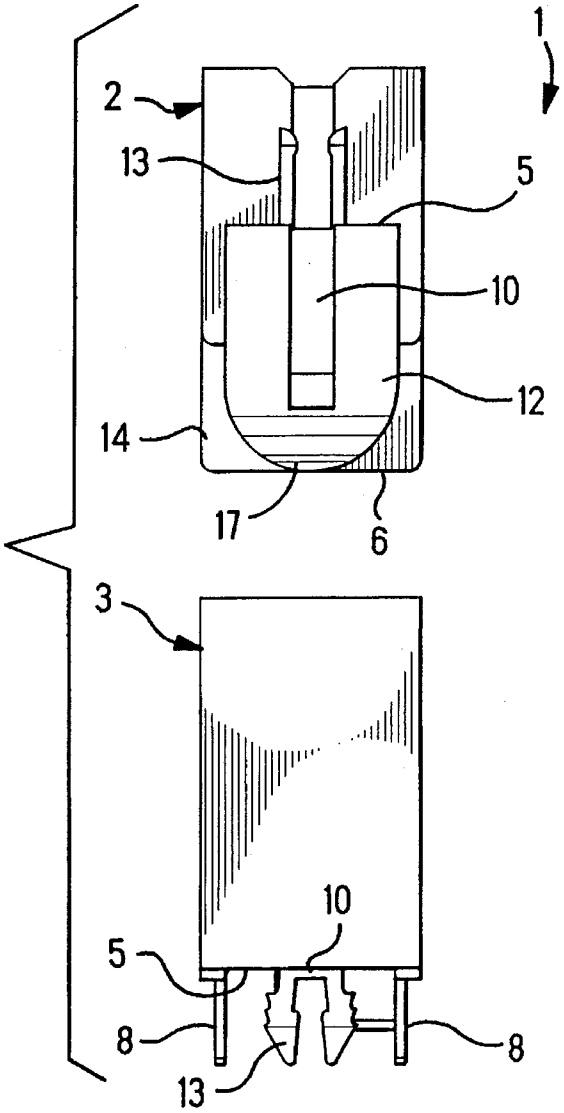
FIG. 3 is an end view of the connectors shown in FIG. 1.
Figure 8:
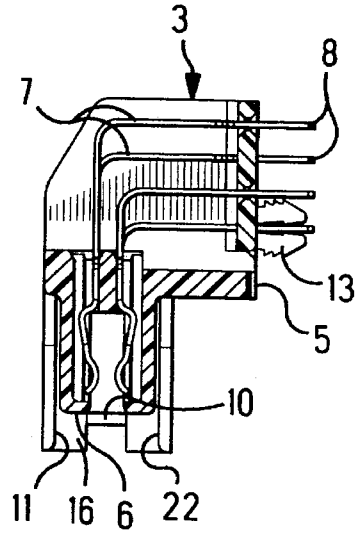
FIG. 8 is a section view taken along line 8—8 of FIG. 7.

With reference to FIGS. 1, 3 and 8, in the mating electrical connector 3 the cavities 11 define post receiving cavities to receive the posts 12 and are in the form of channels on the mating electrical connector 3. The ground contacts 10 are in grooved recesses of the channels, and face opposite open sides of the channels. Open ends 16 of the channels are spaced apart to correspond with the spacing between tips 17 of the posts 12. The ground contacts 10 in the channels receive and engage the ground contacts 10 along the posts 12 upon receipt of the posts 12 along the channels. The posts 12 project so as to align the mating face 6 of the connector 2 with that of the mating electrical connector 3 while the mating faces 6 are spaced apart, and posts 12 and the channels are at opposite ends 18 of connectors 2,3.

Figure 2:
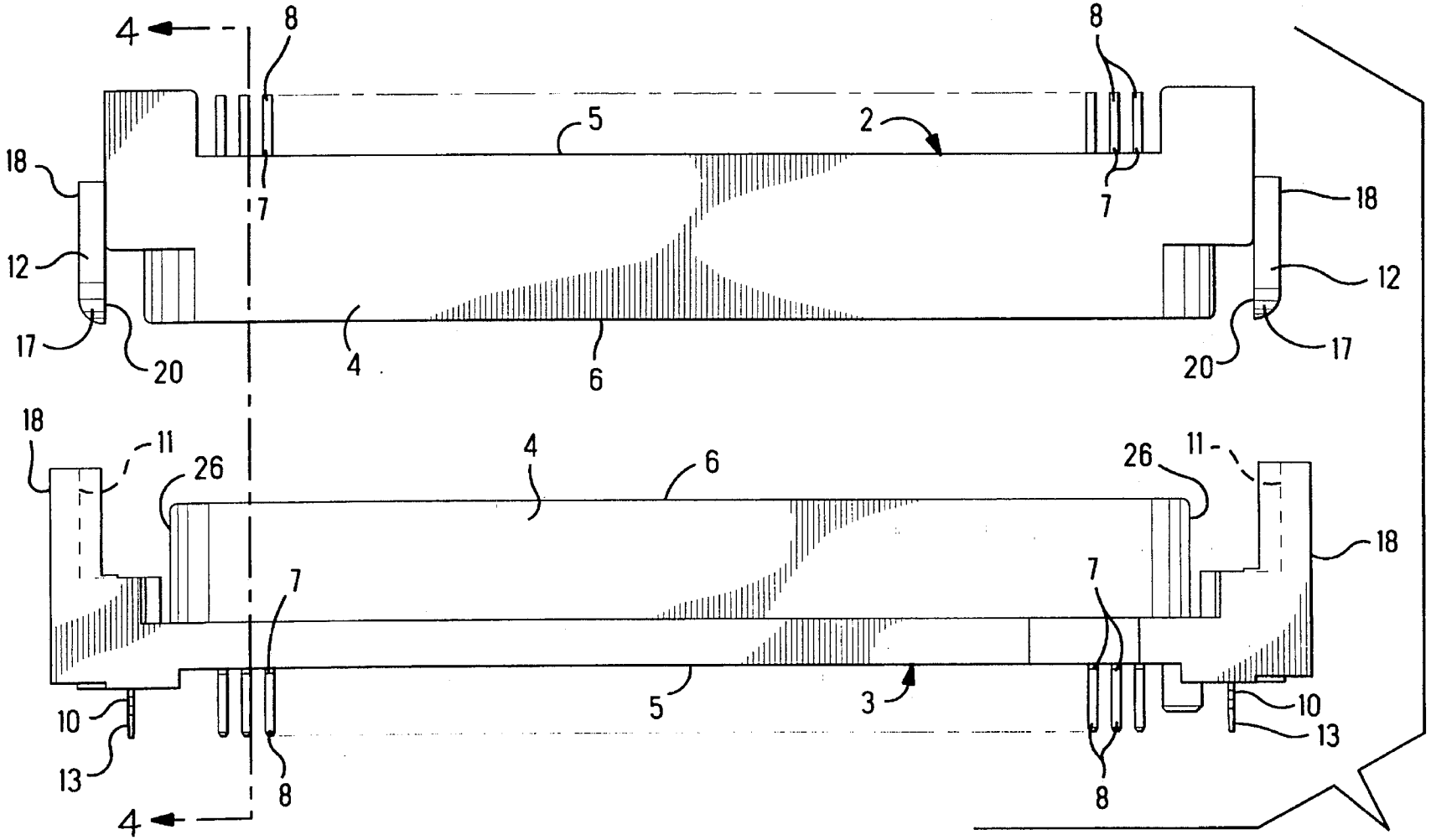
FIG. 2 is a front view of the connectors shown in FIG. 1.
Figure 4:
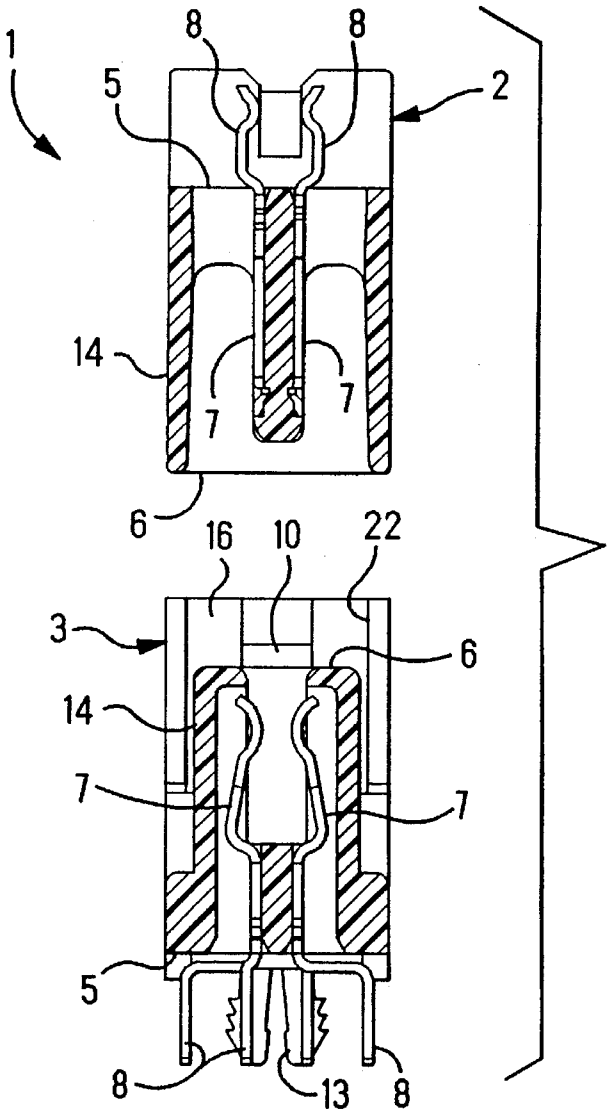
FIG. 4 is a section view of the connectors taken along line 4—4 of FIG. 2.

With reference to FIGS. 1 and 2, alignment of the respective connectors 2, 3, end 18 to end 18, is accomplished by viewing along the posts 12 as sights to target where the posts 12 will align to assure insertion of the posts 12 into the open ends 16 of the channels. The mating connector 3 is often hidden from view inside a chassis, not shown, requiring the posts 12 to enter the chassis through an opening in the chassis. The posts 12 permit alignment of the connectors 2, 3 when the mating connector 3 is hidden from view. The posts 12 thereby facilitate blind mating connection of the connectors 2, 3. An exterior surface 19 of each post 12 is flat for a major portion of its length from back to front, and is tapered with a rounded taper forwardly and inwardly along its length, the taper merging with the tip 17 of the post 12. The surfaces 19 face outwardly away from each other. The ground contacts 10 extend along the surfaces 19. An inward facing surface 20 of the post 12 merges with the surface 19 at the tip 17. The surfaces 20 of the posts 12 face each other. The ground contact receiving cavity 11 is a closed end channel in the surface 19 that communicates with one of the ground contact receiving cavities in the housing 4. The closed end is adjacent to the tip 17. A ground contact 10 extends within the channel and along the surface 19 at the tip 17. The post 12 partially surrounds the portion of the ground contact 10 within the channel.

With reference to FIG. 5, the ground contacts 10 are stamped and formed from a blank of metal and are unitary with a carrier strip, not shown. Each ground contact 10 is separated from the carrier strip 23. An outwardly curved contact surface 21 on the ground contact 10 in the connector 2 projects outwardly of the channel to engage a ground contact 10 on the mating electrical connector 3, when the posts 12 and the ground contacts 10 along the posts 12 are received along the cavities 11 of the mating connector 3 for connection with the ground contacts 10 in the recessed groove portion of the cavities 11 of the mating connector 3.

Figure 7:
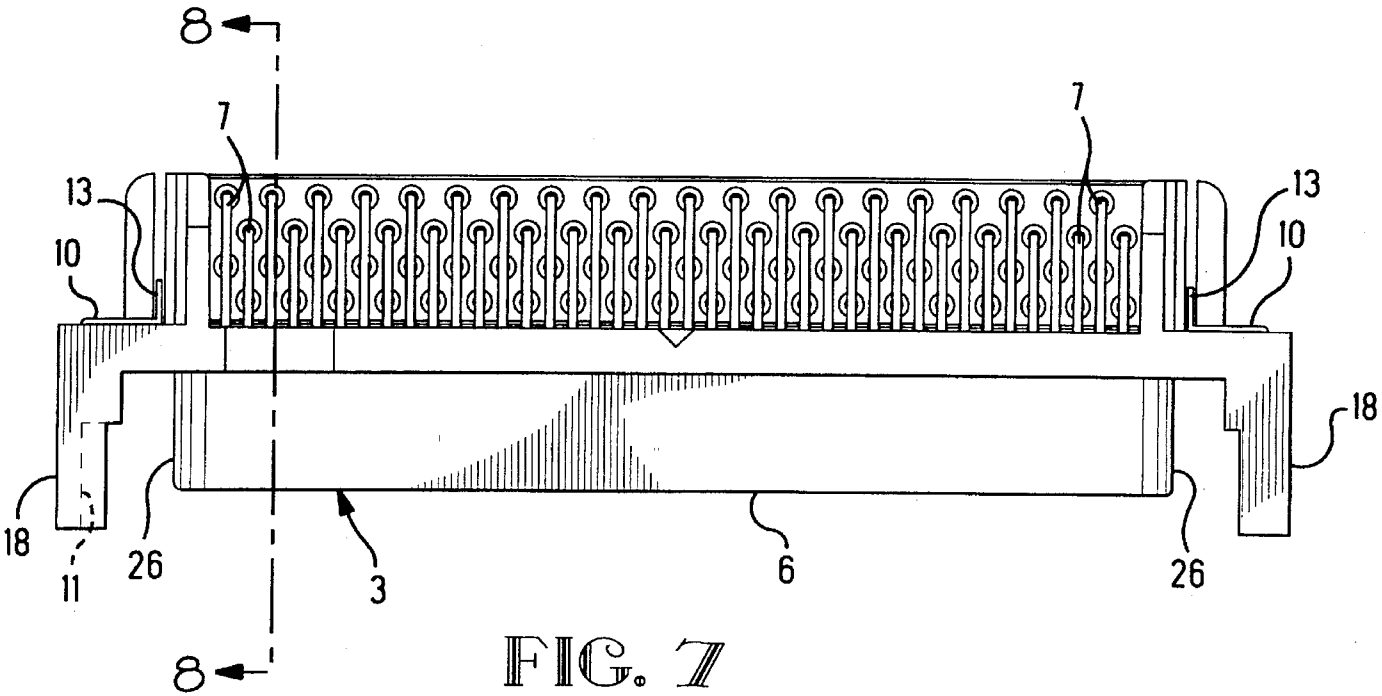
FIG. 7 is a top view of a right angle version of a connector with ground contacts extending along guide post receiving cavities.
Figure 11:
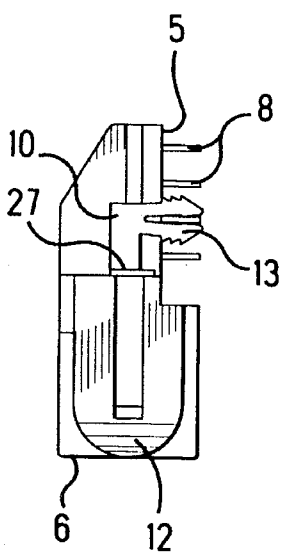
FIG. 11 is an end view of the connector shown in FIG. 10.

With reference to FIGS. 1, 3 and 7, the electrical connector 3 is an electrical receptacle connector having the cavities 11 and the ground contacts 10 projecting outwardly beyond the mating face 6 to align the mating faces of connectors 2 and 3 and to establish a ground connection of the ground contacts 10 to the ground contacts 10 in the posts 12, while the mating faces 6 of connectors 2,3 are spaced apart.

With reference to FIGS. 1, 2 and 7, the ground contact receiving cavities 11 on the connector 3 project beyond the mating face 6 to receive the posts 12 prior to mating of the connectors 2, 3. The ground contacts 10 in the cavities 11 project beyond the mating face 6 of the connector 3 to engage the ground contacts 10 in the posts 12 prior to mating of the connectors 2 and 3. An insulating funnel 22 is on the open end of each of the ground contact receiving cavities 11 in the mating connector 3. The ground contact 10 in each of the cavities 11 is recessed from the open end. Because the ground contacts 10 of both connectors 2, 3 are positioned rearwardly, when the posts 12 are inserted along the cavities 11 of the mating connector 3, the open ends of the cavities 11 will be covered by the posts 12 before the ground contacts 10 of the connectors 2, 3 become engaged. Thereby, the ground contacts and the cavities 11 will be covered safely in the event that electrical arcing might occur when the ground contacts 10 of the connectors 2, 3 approach one another during mating connection.

Prior to connecting the signal contacts along the mating face 6 of the connector 2 with those of the mating electrical connector 3, the ground contacts 10 on the alignment posts 12 engage the ground contacts 10 in the mating electrical connector 3. The ground contacts 10 of the mating connector 3 are connected to chassis ground electrical potential. When the ground contacts 10 of the connectors 2, 3 are engaged, the ground connections of the connector 2 to chassis ground potential are established before the contacts 7 of the connector 2 engage the contacts 7 of the mating connector 3. It can be said of the invention that the subsequent contacts 7, combined with the prior connection of the longer ground contacts 10, provide at least two levels of sequenced electrical connections with the mating electrical connector 3. The contacts 7 are protected from electrostatic charges when such charges discharge to chassis ground. In addition, the connection of the contacts 7 in the respective connectors 2, 3 can be accomplished when the contacts 7 of the mating connector are part of an activated electrical circuit, not shown.

This feature discharges electrostatic charges through the engaged ground contacts 10 to isolate the electrical contacts 7 from such charges during connection and disconnection of the connector 2 and the mating electrical connector 3, especially useful when the contacts 7 of one of the connectors 2, 3 is part of an activated electrical circuit, not shown.

Each connector 2 is capable of being modified to provide a desirable feature wherein mating connection of the electrical contacts 7 themselves of the connectors 2, 3 will occur in sequence. Selected electrical contacts 7 in the connector 2 are positioned forward and closer to the mating face 6 than are the remainder of the electrical contacts 7 when the connector 2 is being viewed from the mating face 6. As the connectors 2, 3 are moved toward each other for mating connection, the forward contacts 7 will engage respective contacts 7 of the other mating connector 3 before the remainder of the contacts 7 in the connector 2 become engaged with the remainder of the contacts 7 of the mating connector 3. This feature provides another level of sequenced electrical connection when the connectors 2, 3 are urged toward one another for mating connection.

With reference to FIG. 6, the connector 2 shown in that Figure is a 50 position vertical plug connector in a straddle mount version that is backwards compatible, because it will mate with a known mating connector 3' that does not have post receiving cavities 11 and ground contacts 10 in the channels. For example, one known mating connector is a CHAMP 0.050 Series 1—Vertical Receptacle for Board-to-Board Applications, and is available as part number 5-175475-6 from AMP Incorporated, Harrisburg Pa. 17105, Product Information Center, Telephone No. 1-800-522-6752.

Figure 10:
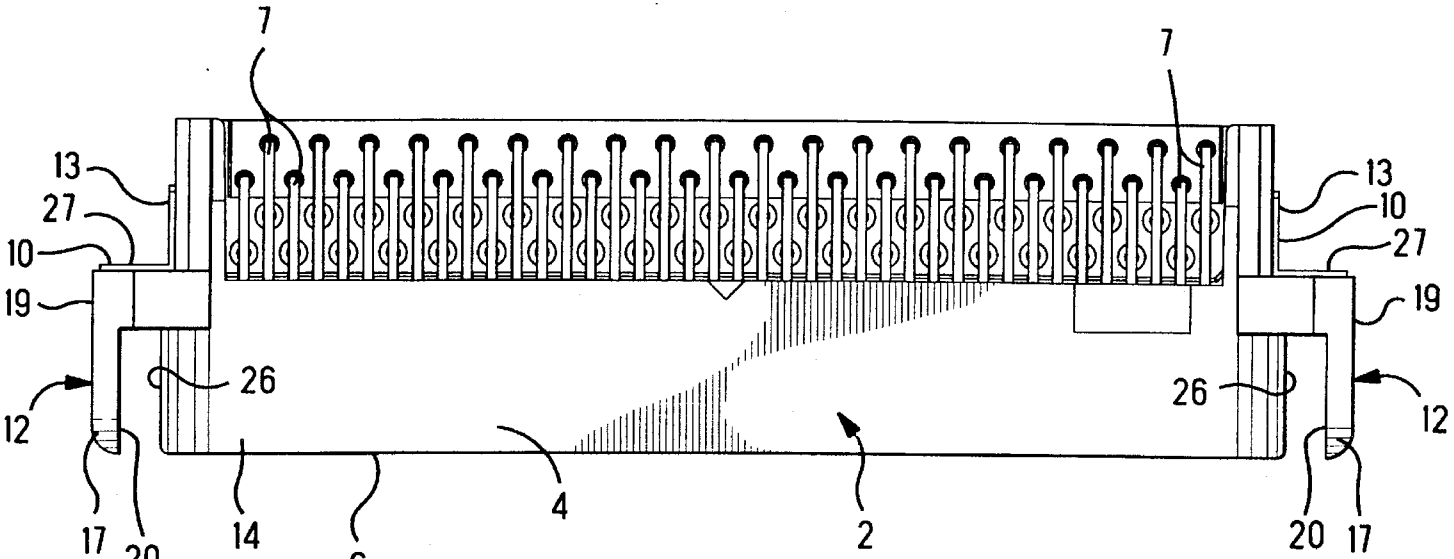
FIG. 10 is a top view of a low profile version of a connector with ground contacts extending along guide posts.

The known mating connector 3' in FIG. 6 comprises an insulating housing 4' having a rear face 5' and a mating face 6', and electrical contacts 7' in and extending through contact receiving cavities through the housing 4' extend from the rear face 5' toward and to the mating face 6'. The known mating connector 3' further comprises; electrical terminals 8' on rear ends of the electrical contacts 7' that project from the rear face 5' for connection to a circuit board, not shown. Each of a pair of board locks on opposite ends of the housing 4' comprises a conductive retention leg 25' encircled by a silo 24' of insulative material unitary with a remainder of the housing 4'. The retention leg 25' provides an electrical ground connection for the board lock, when the retention leg 25 is mounted in a plating lined aperture joined to a ground circuit of a circuit board, not shown. The known mating connector 3' is further available as a right angle version, not shown. Similarly, the connectors 2, FIGS. 1, 2 and 10, are available not for straddle mount, with board locks and retention legs, not shown, in place of posts 12 receiving ground contacts 10.

With reference to FIG. 6, when the plug connector 2 is aligned to mate with the known connector 3', the posts 12 straddle the board locks silos 24'. The posts 12 are spaced laterally from the mating face 6 by respective, board lock receiving spaces 26. The board locks silos 24' are received in the respective spaces 26 to allow mating of the plug connector 2 and the known connector 3'. Accordingly, the posts 12 are spaced apart a distance to straddle the board locks silos 24' when mating the electrical connector 2 with the known electrical connector 3'. Similarly, a right angle version of the connector 2, shown in FIG. 10 is provided with the posts 12 spaced laterally from the mating face 6 by respective board lock receiving spaces 26, to allow straddling of the board lock silos 24' on a right angle version, not shown, of the known mating connector 3'. Similarly, with reference to FIGS. 2 and 7, the post receiving cavities 11 on each connector 3 are spaced laterally from the mating face 6 by board lock receiving spaces 26 to straddle board locks 24 on mating connectors, FIGS. 1, 2 and 7, that have board lock silos, not shown, instead of the posts 12 and ground contacts 10 along the posts 12. Accordingly, the post receiving spaces 26 are provided on the connectors 3 to allow mating with plug connectors 2 that have board.

With reference to FIGS. 2 to 5 and 7 to 12, the electrical terminals 13 on the ground contacts 10 are spaced apart the same distance as are the conductive retention legs 25 of the board locks. Each of the connectors 3 shown in FIGS. 2 and 7 uses the same footprint, i.e., the same pattern of conductive areas on a circuit board to which can be connected the retention legs of the board locks on the known connector 3, shown in FIG. 6. Further to achieve backwards compatibility, the ground contacts 10 of the backwards compatible connectors 2 use the same footprint as do the retention legs of the board locks on the known, previously designed, connectors 2, not shown.

Accordingly, with reference to FIG. 5, the ground contact 10 for the vertical mount version of the connector 3 is provided with an offset portion 27 connecting the terminal 13 and the remainder of the ground contact 10, to offset the terminal 13 from the remainder of the ground contact 10. Similarly, with reference to FIG. 9, the ground contact 10 for the right angle version of the connector 3, shown in FIG. 7, is provided with an offset portion 27 to offset the terminal 13 from the remainder of the ground contact 10. Similarly, with reference to FIG. 12, the ground contact 10 for the low profile, right angle version of the connector 2, shown in FIG. 10, is provided with an offset portion 27. The terminals 13 on the connectors 3, FIGS. 2 and 7, are more closely spaced than the spacing between the remainder of the ground contacts 10 along the ground contact receiving cavities 11.

Other embodiments, features and advantages of the invention are intended to be covered by the spirit and scope of the appended claims.

I claim:

1. An electrical connector comprising, an insulating housing of the electrical connector having a mating face;

electrical contacts in the housing extending toward the mating face for connection with electrical contacts in a mating electrical connector provided with board locks;

insulative posts on the housing; and conductive ground contacts extending along the posts; the posts being spaced laterally from the mating face by respective, board lock silos receiving spaces; and the posts straddling the board locks received in said spaces when the mating face is connected with said mating electrical connector.

2. An electrical connector as recited in claim 1, and further comprising: surfaces of the posts facing outwardly away from each other, the ground contacts extending along said surfaces of the posts.

3. An electrical connector as recited in claim 1 and further comprising: electrical terminals on the ground contacts, and offset portions between the terminals and a reminder of the ground contacts to offset the terminals for backwards compatibility.

4. An electrical connector as recited in claim 1 wherein ends of the posts are tapered inwardly and are rounded.

5. An electrical connector assembly comprising:

a first connector matable with a first mating connector and being matable with a second mating connector having spaced apart board lock silos;

insulating guide posts on the first connector, the posts being spaced apart a distance to straddle the board lock silos when mating the first connector with the second mating connector;

conductive first ground contacts in the guide posts;

a first mating connector matable with the first connector and having post receiving cavities for receiving the guide posts thereof;

second ground contacts in the cavities electrically connectable with the first ground contacts in the guide posts; and electrical terminal portions on the second ground contacts spaced apart the same distance as board locks in the board lock silos of the second mating connector.

6. An electrical connector as recited in claim 1 wherein surfaces of the guide posts face outwardly away from each other, the first ground contacts extending along said outwardly facing surfaces.

7. An electrical connector as recited in claim 5 and further comprising electrical terminals on the first and second ground contacts, and offset portions between the terminals and a remainder of the first and second ground contacts to offset the terminals for backwards compatibility.

8. An electrical connector assembly as recited in claim 5, wherein the post receiving cavities on the first mating electrical connector being laterally spaced from a mating face of the first mating electrical connector by board lock silo receiving spaces.

9. An electrical connector assembly as recited in claim 5 wherein the cavities and the second ground contacts in the cavities project beyond a mating face of the first mating electrical connector.

10. An electrical connector assembly as recited in claim 5 wherein ends of the guide posts are tapered inwardly and are rounded.

11. An electrical connector assembly comprising:

a first connector matable with a first mating connector and being matable with a second mating connector having spaced apart board lock silos;

insulating guide posts on the first connector, and conductive first ground contacts in the guide posts;

a first mating connector matable with the first connector and having spaced apart cavities receiving the guide posts;

second ground contacts in the cavities electrically connectable with the first ground contacts in the guide posts;

electrical terminal portions on the second ground contacts being spaced apart the same distance as are board locks in the board lock silos; and the terminal portions being more closely spaced together than are the second ground contacts in the cavities.

12. An electrical connector as recited in claim 11 wherein surfaces of the guide posts face outwardly away from each other, the first ground contacts extending along said outwardly facing surfaces.

13. An electrical connector as recited in claim 11 and further comprising: electrical terminals on the ground contacts, and offset portions between the terminals and a remainder of the ground contacts to offset the terminals for backwards compatibility.

14. An electrical connector assembly as recited in claim 11 wherein end of the guide posts are tapered inwardly and are rounded.

15. An electrical connector assembly, comprising:

a first connector provided with electrical contacts extending toward a mating face of a housing thereof, the first connector housing being provided with alignment posts and first ground contacts along the posts; and a mating connector provided with electrical contacts extending toward a mating face of a housing of the mating connector for connection with the contacts in the first connector;

the mating connector housing being provided with post receiving cavities defined in end portions of the housing and second ground contacts in the cavities engaging the first ground contacts;

the housing end portions containing the post receiving cavities projecting beyond the mating face of the mating connector to engage the posts; and the second ground contacts in the cavities also projecting beyond the mating face of the mating connector to engage the first ground contacts, so that the electrical contacts of the connectors electrically engage subsequent in sequence to engagement of the first and second ground contacts during mating of the connectors.

* * * * *